United States Patent [19]

Salama

[11] 4,364,801

[45] Dec. 21, 1982

[54] METHOD OF AN APPARATUS FOR SELECTIVELY SURFACE-TREATING PRESELECTED AREAS ON A BODY

[75] Inventor: Amir Salama, Cartierville, Canada

[73] Assignee: Northern Telecom Limited, Montreal, Canada

[21] Appl. No.: 278,865

[22] Filed: Jun. 29, 1981

[51] Int. Cl.[3] ..... C25D 5/02; C25D 17/00

[52] U.S. Cl. ..... 204/15; 204/27; 204/224 R; 118/301; 118/504; 427/282; 427/421; 427/424

[58] Field of Search ..... 427/282, 421, 424; 118/62, 63, 301, 504; 204/15, 27, 224 R, 198, 277

[56] References Cited

U.S. PATENT DOCUMENTS

| | | | |
|---|---|---|---|
| 2,088,542 | 7/1937 | Westin | 118/301 |
| 2,750,332 | 6/1956 | Miller | 204/224 R X |
| 3,178,305 | 4/1965 | Ward | 204/15 |
| 3,223,549 | 12/1965 | Fredley et al. | 118/62 X |
| 3,835,017 | 9/1974 | Mentone et al. | 204/224 R |
| 4,032,414 | 6/1977 | Helder et al. | 204/224 R X |

FOREIGN PATENT DOCUMENTS

| | | | |
|---|---|---|---|
| 2219127 | 8/1974 | France | 427/424 |
| 642016 | 1/1979 | U.S.S.R. | 118/63 |

*Primary Examiner*—Shrive P. Beck
*Attorney, Agent, or Firm*—Sidney T. Jelly

[57] ABSTRACT

The treatment of a selected area of a body by a solution is obtained by ejecting the solution towards the body and ejecting gas to control the flow of solution to restrict contact between solution and body to the selected area. The invention is particularly concerned with the plating of part of one surface of a rectangular cross-sectioned pin, for example a terminal pin. A particular example is the gold plating of one end of one surface of a rectangular terminal pin, while preventing plating of the other surfaces. Pins, in bandoliers, are carried through a tank, with nozzles on each side. Solution is ejected at one side and a gas at the other side. The gas flows round the pins and restricts wetting to one surface of the pin.

21 Claims, 7 Drawing Figures

METHOD OF AN APPARATUS FOR SELECTIVELY SURFACE-TREATING PRESELECTED AREAS ON A BODY

This invention relates to the selective surface treating of a preselected area, or areas, of a body, and is particularly though not exclusively, concerned with plating on a particular area of a surface of a member, for example on an area of one surface of a rectangular section pin.

Plating by immersion in a plating solution is used for many applications, plating occurring on all areas contacted by the solution. The process can be automated, and for relatively small objects and thin coatings, can be part of a manufacturing line. Plating can also be carried out by contacting a surface with a porous or filamentous member, such as a sponge or brush, to which solution is fed, with relative movement between the sponge or brush and the member being plated. However, such methods are usually slower than immersion plating, are not suitable for small or restricted areas, and is difficult to build into a manufacturing line as results are often variable.

The present invention provides for a method of selectively contacting a predetermined area of a body with a flow of liquid, while preventing contact with other areas. Particularly, a predetermined area, or predetermined areas, are contacted by a solution by emitting the solution towards the body and controlling the flow path of the solution by a gas flow. Thus, in a particular example of electro-plating a part of one surface of a rectangular metal pin, the solution is emitted towards the pin, the gas flow permitting the solution to impinge on a front surface and at least substantially preventing the solution from wetting the sides and back surfaces.

The invention is particularly useful in the gold plating of terminal pins and other electrical contact means. Gold being very expensive, plating of surfaces not required to be plated, as in a pin making contact on only one surface, results in the use of more gold than necessary. Thus the invention provides for a considerable reduction in costs. The process, and apparatus, can be continuous and be part of a manufacturing line.

The basic principle of the invention, and specific details, will be readily understood by the following description of certain embodiments, by way of example, in conjunction with the accompanying diagrammatic drawings, in which.

Figure 1:
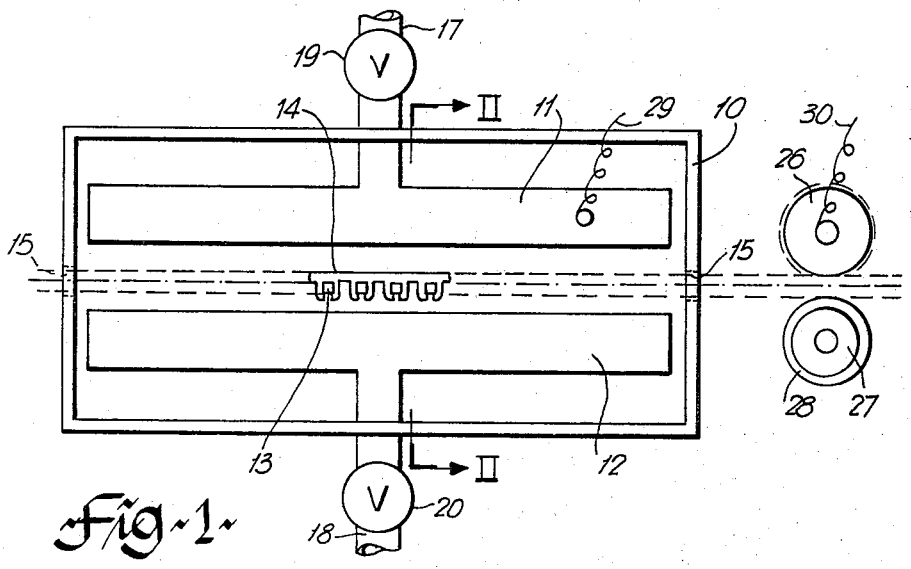
FIG. 1 is a top plan view of one form of apparatus for carrying out the invention.
Figure 2:
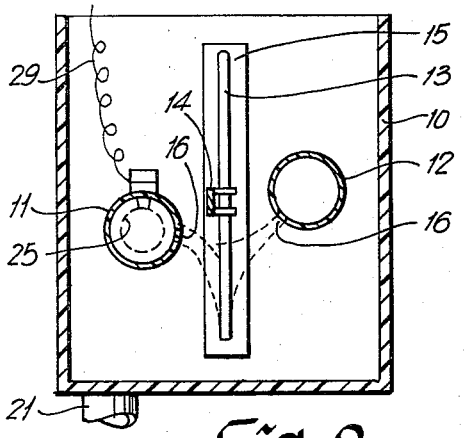
FIG. 2 is a cross-section on the line II—II of FIG. 1.

FIGS. 1 and 2 illustrate one form of apparatus, which comprises a tank 10, a plating solution manifold 11 and an air manifold 12. The manifolds 11 and 12 are positioned on either side of a path followed by, in the present example, terminal pins 13 carried in a bandolier 14. The bandolier and pins enter and exit the tank through apertures 15 in the tank ends.

In each manifold there is a longitudinal slot or nozzle 16, and solution and air are supplied to the manifolds 11 and 12 by supply pipes 17 and 18 respectively. Flow control valves 19 and 20 are positioned in the supply pipes 17 and 18. Solution drains from the tank via drain pipe 21. The process is applicable to both electrolytic and non-electrolytic plating. In the embodiment illustrated in FIGS. 1 and 2, electrolytic plating is carried out. The anode is seen at 25 in FIG. 2 and is a gauze tube although other forms of anode can be provided. Cathodic connection is made to the bandolier and terminal pins via a metal wheel 26, which conveniently has teeth on the periphery which engage in perforations in the bandolier to provide a drive. The bandolier is backed up by a further wheel 27, which can have a rubber or other elastomeric material rim 28. While not shown, wheels similar to 22 and 27 can be provided also at the other end of the tank. Electrical connections are made to the anode 25 and wheel 26 via conductors 29 and 30. The method is as follows. Plating solution suited to the metal to be plated on to the terminal pins 13 is fed via pipe 17 to the manifold 11. The pressure of the solution can be predetermined and the valve 19 used to control volumetric flow. Alternatively the pressure and flow rate can be controlled. Air, or other acceptable gas, is fed to the manifold 12 via pipe 18, the flow rate, pressure, or flow rate and pressure controlled at 20.

The solution issues through slot or nozzle 16 in manifold 11 and the gas issues through slot or nozzle 16 in the manifold 12. The solution would normally issue more or less directly on to the pins 13 and would wet all surfaces, running down the surfaces, with plating occurring on all of the surfaces. However the gas flow is controlled such that the solution flow is deflected downwards and also prevented from flowing between the pins, the solution only wetting the pin surface facing the manifold 11. By this means only the one surface of the pin is plated, and by the relative positioning of the pins and manifolds, and the rotational positions of the slots or nozzles 16, the length of the pin plated is also controlled with very little, or no, plating on the side surfaces of the pins.

The solution drains through the pipe 21 back to a holding tank from which it is recirculated back to manifold 11. Any adjustments necessary to the chemical composition of the solution can be made at the holding tank. The bandolier and pins are moved through the tank at a predetermined speed and the length of the tank, in combination with the speed of travel of the bandolier, and other controllable variables such as composition and temperature of the solution, determine the thickness of the plating.

If air is used as the gas, the tank can be left open at the top, although for safety, particularly when gold plating for example, a lid would be provided, with a vent. The vent may have a trap to at least greatly reduce any carry over of solution by the air. If other gases are used, for example, $CO_2$, nitrogen, or the like, a lid can be provided, and the gas collected, dried, and reused.

For non-electrolytic plating, the only difference would be the non-provision of the anode 25 and electrical connections 29 and 30. Wheels 26 and 27 would still likely be provided, and probably at both ends, to feed and guide the pins and bandolier through the tank. Also, of course, the solution supplied to the manifold 11 would be such as to be suitable for such plating.

Figure 3:
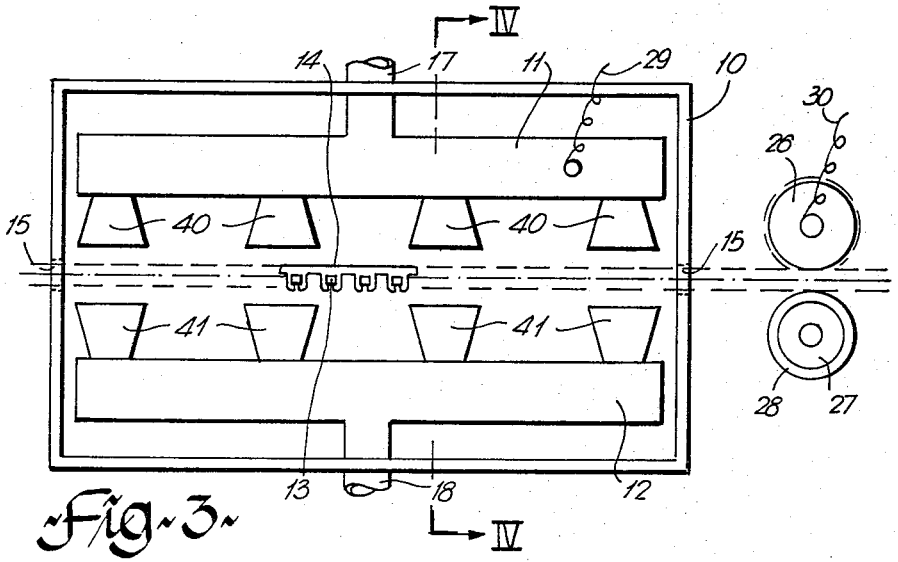
FIG. 3 is a top plan view of an alternative form of apparatus for carrying out the invention.
Figure 4:
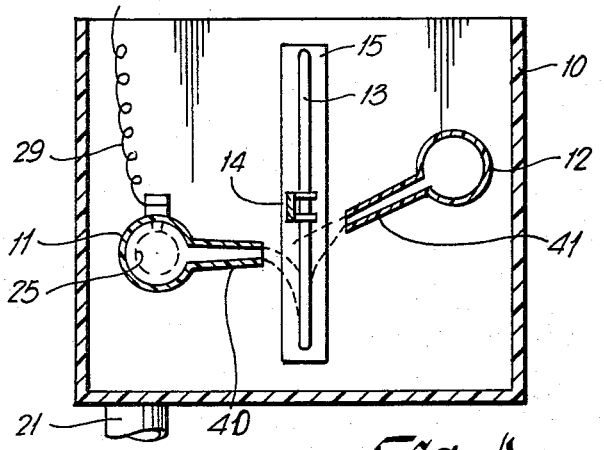
FIG. 4 is a cross-section on the line IV—IV of FIG. 3.

Instead of a continuous jet of solution, and air, as is obtained with the slots or nozzles 16 in FIGS. 1 and 2, a plurality of short slots or nozzles can be used. Such an arrangement is illustrated in FIGS. 3 and 4. Many of the details of FIGS. 3 and 4 are the same as in FIGS. 1 and 2 and these details have the same reference numerals. As illustrated in FIGS. 3 and 4, there are the two manifolds 11 and 12 in the tank 10, with the pins 13 on bandolier 14 passing between them. Solution manifold 11 has four elongate nozzles 40 spaced along the manifold. Similarly the manifold 12 has four elongate nozzles 41. Anode 25 is provided, wheels 26 and 27 and electrical connections 29 and 30. Solution is supplied to manifold 11 by the supply pipe 17, and gas is supplied to manifold 12 by supply pipe 18. While not shown, control valves are provided, as in FIG. 1. Solution drains from the tank via drain pipe 21.

Figure 5:
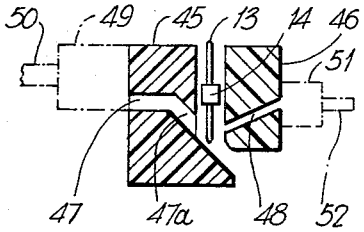
FIGS. 5 and 6 are cross-sections illustrating two further forms of solution and gas nozzles.
Figure 6:
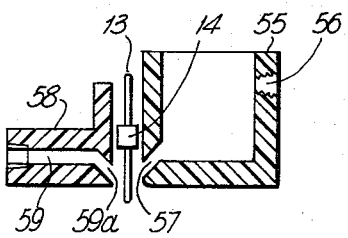

FIGS. 5 and 6 illustrate two alternate nozzle formations which also provide some guidance and support for the pins and bandolier. In FIG. 5 a solution nozzle block or member 45 and a gas nozzle block or member 46 are spaced apart to define a passage through which passes the pins and bandolier 13, 14. The solution nozzle block has a nozzle 47 which is inclined inward and downward at its exit portion 47*a*. The gas nozzle block has a nozzle 48 also inclined inward and downward. Solution is fed to passage 47, 47*a*, for example from a reservoir or manifold 49 having a supply inlet 50. Gas is fed to passage 48 via a manifold 51 fed via a pipe 52.

In FIG. 6, a solution holding tank 55, fed via an inlet 56, has a downwardly inclined nozzle 57. A gas nozzle member 58 has a nozzle 59 inclined downward at its end portion 59*a*.

The nozzles 47, 47*a* and 48 in FIG. 5, and the nozzles 57 and 59, 59*a* in FIG. 6, can be continuous in that they form elongated nozzles, as in FIGS. 1 and 2, or can be in the form of individual short nozzles, as in FIGS. 3 and 4. They can also be in other shapes. The arrangements illustrated in FIGS. 5 and 6 provide some lateral guidance and support for pins and bandolier.

Figure 7:
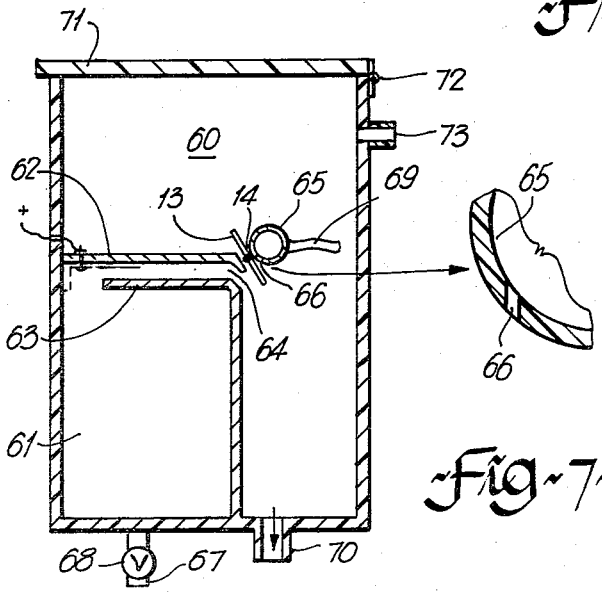
FIG. 7 is a cross-section, similar to those of FIGS. 2 and 4, illustrating a further form of apparatus.

FIG. 7 illustrates a further alternative arrangement. The Figure is a transverse cross-section, similar to FIGS. 2 and 4. As illustrated in FIG. 7, there is a tank 60, having a reservoir 61 at the bottom, at one side. The reservoir has two spaced apart top members 62, 63, which define a solution passage, the passage having an outlet or nozzle 64, which, in the present example, is downwardly inclined. Spaced from the nozzle 64 is a gas manifold 65 having a slot or nozzle 66 therein. Solution is fed to the reservoir 61 via an inlet pipe 67, controlled by a valve 68. Gas is supplied to the manifold 65 via a flexible pipe 69. A drain 70 is provided in the bottom of the reservoir. A cover 71 is hingedly attached, at 72, to the top of the reservoir, and a vent 73 is also provided.

The bandolier and pins pass through the tank between the nozzle 64 and the manifold 65. In the arrangement of FIG. 7, the bandolier and pins can be tilted, relative to the vertical, as shown. The angle of inclination of the pins 13 relative to the nozzle 64 can be varied. Also, the manifold 65 can be rotated so as to vary the angle of issuance of gas from the nozzle 66. The angle of inclination of the pins 13 is obtained readily by mounting the wheels which feed the bandolier and pins through the tank so that their rotational axes can be tilted. The manifold 65 can be mounted in bushes at each end of the tank to permit of rotation. The inclination of the pins relative to the nozzle 64 can assist in controlling the area over which the solution contacts each pin, and can reduce gas flow requirements. In the example of FIG. 7, an angle 75 in the form of a length of gauze, for example gold gauze for gold plating, is positioned in the passage formed by the members 62 and 63. This anode would be omitted for non-electrolytic plating.

In certain plating processes, it is necessary to first apply one metal before applying the final, desired, metal. Thus, for example, it may be necessary first to nickel plate before gold plating. In such instances a tank and the associated nozzles and other details can be provided for each metal to be plated. Washing stations can be provided after each plating position.

Baffles may be provided in the tanks to cut down the spray which reaches the gas outlet from the tank. Guides may be provided in the tank for the pins and bandolier to prevent undue movement, or vibration, of pins and bandolier resulting from the impingement of solution and gas. Thus, for example, the structure of FIGS. 5 and 6 will provide guidance.

It is the relative flows of solution and gas, and the relative positioning of the nozzles or slots, which predetermine the areas plated, the position of the article being plated relative to the nozzles also being relevant. The concept of the invention is the use of the principle of momentum balance of two heterogeneous fluid flows, to guide the liquid flow on a specific area of an object, whereby certain physical or chemical changes will take place.

The invention, while having been described particularly with reference to plating, can be used for the chemical removal of material, as by etching. The invention can also be used to control the application of paints, inks and other materials in solution form to predetermined areas.

Taking as an example, the embodiment illustrated in FIGS. 1 and 2, some typical dimensions and other data for electrolytically gold plating pins of the order of 0.025" square, for a distance of about half an inch at the lower end are as follows. The manifolds 11 and 12 can be between about eighteen to twenty-four inches long, with the solution nozzle about 0.2 inches and the gas nozzle about 0.02 inches. The pins are spaced about 0.2 to 0.3 inches from the nozzle outlets. The manifold 12 is usually spaced half an inch to an inch, but this is variable. The solution flow rate is from about 1 gallon per hour to about 5 gallons per hour, with gas supplied at about 40 psi. The bandolier travels at between about five and ten feet per minute. The voltage is in the approximate range of 5–10 volts, and the amperage between 0.5 and 1.0 amp approximately. A typical plating thickness is between 50 and 70 microns. These values are, for obvious reasons, exemplary only, and can be varied for different materials and different plating thicknesses, for example.

For opposite surfaces of a square pin to be plated then two tanks in series can be used, with plating on one side in one tank and on the other side in the other tank.

What is claimed is:

1. A method of electro-plating a front surface of an elongate terminal pin having a rectangular cross-section;

including ejecting a plating solution against the front surface of said pin and ejecting a gas to prevent wetting of a back surface and both side surfaces of the pin.

2. A method as claimed in claim 1, for electro-plating said preselected area, including supplying electrical power to said solution and said body.

3. A method as claimed in claim 1, including controlling the flows of solution and gas to a momentum balance of the two flows to control the area wetted by said solution.

4. A method as claimed in claim 1, including varying the angle of ejection of at least one of said solution and said gas, relative to the longitudinal axis of a pin.

5. Apparatus for electro-plating a front surface of a rectangular terminal pin, comprising means for ejecting a plating solution toward said front surface; and means for ejecting a gas towards a back surface of the pin, and across a side surface on each side of a pin, said gas controlling the flow of the plating solution in contact with said pin to permit contact by said plating solution only on said front surface.

6. Apparatus as claimed in claim 5, including an anode in the flow path of the plating solution, and means for connecting an electrical power supply to said anode and to said pin, said anode being of the material to be plated on said pin.

7. Apparatus as claimed in claim 5, said means for ejecting a plating solution comprising at least one elongate nozzle; and said means for ejecting a gas comprising at least one elongate nozzle; and means for moving said body past said nozzles.

8. Apparatus as claimed in claim 7, said nozzles on opposite sides of said body.

9. Apparatus for continuously plating at least a part of one surface of a plurality of elongate terminal pins having a rectangular cross-section, comprising:

a tank;

means for moving said pins in vertical array successively along a path through said tank;

a first manifold positioned on one side of said path;

means for supplying a controlled flow of plating solution to said first manifold;

said first manifold including at least one nozzle facing towards said path for ejection of plating solution towards said pins;

a second manifold positioned on the other side of said path;

means for supplying a controlled flow of gas to said second manifold;

said second manifold including at least one nozzle facing towards said path;

said gas flow controlling the flow of said plating solution in contact with said pin to permit contact by said plating solution only on said part of one surface.

10. Apparatus as claimed in claim 9, for electro-plating said surface, including an anode in the path of the plating solution and means for applying electrical power to said anode and to said pins.

11. Apparatus as claimed in claim 10, for plating pins held in a bandolier, said means for moving said pins comprising at least one pair of wheels engaging with said pins and bandolier, electrical power supplied to said pins by at lest one of said wheels.

12. Apparatus as claimed in claim 11, said anode comprising a gauze member in said path of the plating solution.

13. Apparatus as claimed in claim 12, for gold plating, said gauze member being of gold.

14. Apparatus as claimed in claim 9, including a nozzle extending substantially for the length of said first manifold, said nozzle being a slot in the periphery of the manifold.

15. Apparatus as claimed in claim 9, including a nozzle extending substantially for the length of said second manifold, said nozzle being a slot in the periphery of the manifold.

16. Apparatus as claimed in claim 9, including a plurality of nozzles spaced apart along said first manifold.

17. Apparatus as claimed in claim 9, including a plurality of nozzles spaced apart along said second manifold.

18. Apparatus as claimed in claim 9, including a nozzle block extending along one side of said path, said nozzle block attached to said first reservoir, and a second nozzle block on the other side of said path and forming said gas supply nozzle; said nozzle blocks spaced to form a passage for said pins.

19. Apparatus as claimed in claim 18, including a second manifold on the other side of said path, said second nozzle block attached to said second manifold.

20. Apparatus as claimed in claim 9, said first manifold having a vertical surface facing toward said path, said at least one nozzle comprising a slot formed at the bottom of said surface.

21. Apparatus as claimed in claim 9, said first manifold comprising a reservoir in said tank; said reservoir including two spaced apart top members defining a passage for the solution, and said nozzle formed at an outlet of said passage; said second manifold rotatably mounted in said tank for rotation about a longitudinal axis, whereby the angle of ejection from the gas nozzle is variable.

* * * * *